US009249627B2

(12) United States Patent
Parlin

(10) Patent No.: US 9,249,627 B2
(45) Date of Patent: Feb. 2, 2016

(54) SWELLING DEBRIS BARRIER AND METHODS

(75) Inventor: Joseph DeWitt Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/697,798

(22) PCT Filed: Feb. 16, 2012

(86) PCT No.: PCT/US2012/025407

§ 371 (c)(1),
(2), (4) Date: Sep. 15, 2014

(87) PCT Pub. No.: WO2013/122589

PCT Pub. Date: Aug. 22, 2013

(65) Prior Publication Data

US 2015/0027714 A1 Jan. 29, 2015

(51) Int. Cl.

| | |
|---|---|
| ***E21B 33/12*** | (2006.01) |
| ***E21B 37/00*** | (2006.01) |
| ***E21B 7/06*** | (2006.01) |
| ***E21B 41/00*** | (2006.01) |

(52) U.S. Cl.

CPC ..... *E21B 7/061* (2013.01); *E21B 33/12* (2013.01); *E21B 33/1208* (2013.01); *E21B 37/00* (2013.01); *E21B 41/0035* (2013.01)

(58) Field of Classification Search

None

See application file for complete search history.

(56) References Cited

U.S. PATENT DOCUMENTS

| | | | | |
|---|---|---|---|---|
| 6,019,173 | A | 2/2000 | Saurer et al. | |
| 6,092,601 | A | 7/2000 | Gano et al. | |
| 6,125,937 | A * | 10/2000 | Longbottom | E21B 23/002 166/117.5 |
| 6,915,847 | B2 * | 7/2005 | Brockman | E21B 47/06 166/250.08 |
| 7,441,596 | B2 * | 10/2008 | Wood | E21B 33/1208 166/179 |
| 2002/0112857 | A1 * | 8/2002 | Ohmer | E21B 17/203 166/313 |
| 2003/0178196 | A1 | 9/2003 | Smith | |
| 2008/0296029 | A1 | 12/2008 | Ortiz | |

FOREIGN PATENT DOCUMENTS

GB 2397835 A 8/2004

OTHER PUBLICATIONS

International Search Report and Written Opinion for PCT/US2012/025407 dated Oct. 8, 2012.

Supplementary European Search Report for EP Patent Application No. 12868693.8 dated Jul. 23, 2015.

* cited by examiner

*Primary Examiner* — Matthew R Buck
*Assistant Examiner* — Douglas S Wood
(74) *Attorney, Agent, or Firm* — McDermott Will & Emery LLP; Alan Bryson

(57) ABSTRACT

The present invention provides systems and methods for protecting the lower main wellbore of whipstocks and completion deflectors from debris accumulation. A well system subassembly includes a deflector tool arranged within a casing string and defining a deflector surface and an inner bore extending longitudinally from the deflector surface and one or more seal stacks disposed about the inner bore of the deflector tool. A wellbore barrier device is disposed about the inner bore uphole from the one or more seal stacks and is expandable from an unswelled configuration to a swelled configuration. When the wellbore barrier device is in the swelled configuration, it protects the one or more seal stacks from debris generated from milling and/or drilling operations.

20 Claims, 5 Drawing Sheets

SWELLING DEBRIS BARRIER AND METHODS

CROSS-REFERENCE TO RELATED APPLICATION

The present application is a national stage entry of and claims priority to International App. No. PCT/US2012/025407, filed on Feb. 16, 2012.

BACKGROUND

The present invention relates to equipment utilized and operations performed in conjunction with a subterranean well and, more particularly, to systems and methods for protecting the lower main wellbore of whipstocks and completion deflectors from debris accumulation.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction and can include a main wellbore in the first general direction and a secondary wellbore diverted from the main wellbore in the second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a casing joint and a whipstock in a casing string at a desired location in the main wellbore. The whipstock is used to deflect one or more mills laterally (or in an alternative orientation) relative to the casing string. The deflected mill(s) penetrates part of the casing joint to form the casing exit in the casing string. Drill bits can be subsequently inserted through the casing exit in order to cut the lateral or secondary wellbore.

During lateral drilling operations, it is desirable to protect lower portions of the main wellbore from the accumulation of debris that results from drilling. Such debris can plug the main wellbore and prevent follow on operations such as retrieving whipstocks or deflectors or the opening of fluid loss devices. One way of preventing debris is through the use of mechanical barriers, such as flapper valves, plugs, disks, etc. With the accumulation of a large amount of debris, however, it may be difficult to subsequently open the flapper valve for follow on operations or retrieve the plug or disk from the main wellbore. Another way of preventing debris buildup in the main wellbore is by protecting the area in question with one or more viscous fluids. Formulating the appropriate viscosity or mixture of the viscous fluid for each wellbore application, however, can oftentimes be difficult and as a result large amounts of drilling debris will nonetheless continue to pass through the viscous fluid.

SUMMARY OF THE INVENTION

The present invention relates to equipment utilized and operations performed in conjunction with a subterranean well and, more particularly, to systems and methods for protecting the lower main wellbore of whipstocks and completion deflectors from debris accumulation.

In some embodiments, a well system subassembly is disclosed. The subassembly may include a deflector tool arranged within a casing string and defining a deflector surface and an inner bore extending longitudinally from the deflector surface. The subassembly may also include one or more seal stacks disposed about the inner bore of the deflector tool, and a wellbore barrier device disposed about the inner bore and arranged uphole from the one or more seal stacks and being expandable from an unswelled configuration to a swelled configuration. When the wellbore barrier device is in the swelled configuration, the wellbore barrier device may be configured to protect the one or more seal stacks from debris generated from milling and/or drilling operations.

In some embodiments, a method of installing a wellbore system subassembly in a well is disclosed. The method may include arranging a deflector tool having an inner bore within a casing string cemented into the well. The deflector tool may have one or more seal stacks and a wellbore barrier device disposed about the inner bore. The wellbore barrier device may be arranged uphole from the one or more seal stacks. The method may also include expanding the wellbore barrier device inwardly from an unswelled configuration to a swelled configuration, and protecting with the swelled wellbore barrier device the one or more seal stacks from debris. The method may further include advancing a tubular string into the casing string. The tubular string may be separated into at least a first production tubular and a second production tubular. The method may also include penetrating the swelled wellbore barrier device with the first tubular string.

In some embodiments, another well system subassembly is disclosed. The subassembly may include a combination whipstock/deflector defining a deflector surface and an inner bore extending longitudinally from the deflector surface, and one or more seal stacks disposed about the inner bore of the combination whipstock/deflector. The subassembly may further include a swellable elastomer disposed about the inner bore and arranged above the one or more seal stacks. The swellable elastomer may be expandable from an unswelled configuration to a swelled configuration. When the swellable elastomer is in the swelled configuration, the swellable elastomer may be configured to protect the one or more seal stacks from debris accumulation.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to equipment utilized and operations performed in conjunction with a subterranean well and, more particularly, to systems and methods for protecting the lower main wellbore of whipstocks and completion deflectors from debris accumulation.

The present invention provides a wellbore barrier used to protect seals and the lower portion of the main wellbore from debris that may accumulate during lateral wellbore drilling operations. In some embodiments, the wellbore barrier may be a swellable elastomer arranged on the inner diameter of an inner bore defined in a deflector tool, such as a whipstock, completion tool, or combination whipstock/completion tool. In its expanded configuration, the swellable elastomer protects a seal stack arranged in the inner bore of the deflector tool from damage caused by debris, which damage could compromise subsequent hydrocarbon production and/or allow the influx of sand. Moreover, the swollen swellable elastomer may provide a barrier around seal stingers or other wellbore assemblies pushed through it. Lastly, while other wellbore barriers are configured for one time usage, the exemplary wellbore barriers disclosed herein may be used multiple times.

Figure 1:
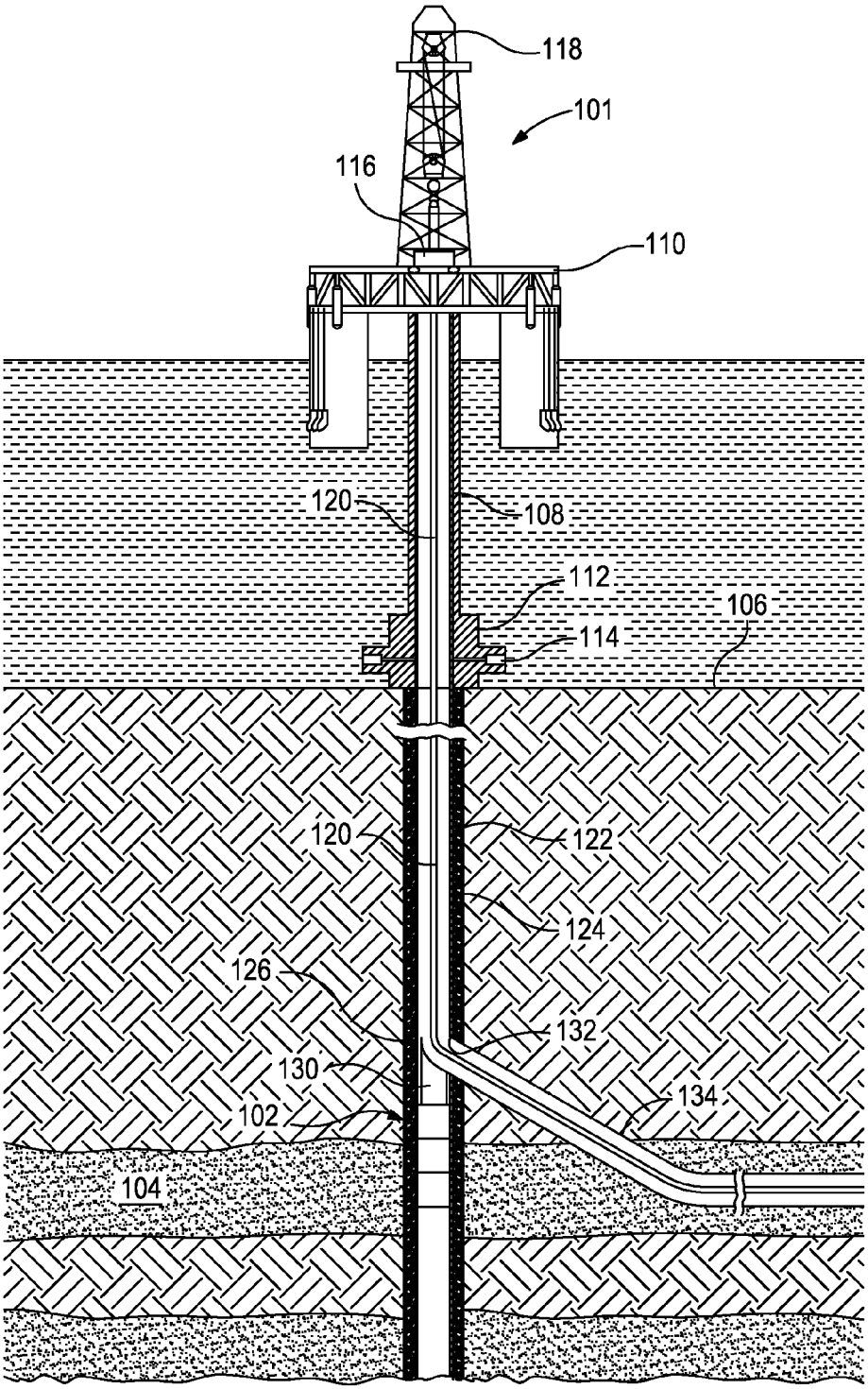
FIG. 1 illustrates an exemplary well system subassembly as used in conjunction with, for example, an offshore oil and gas platform, according to one or more embodiments.

Referring to FIG. 1, illustrated is an exemplary well system subassembly 102 as used in conjunction with, for example, an offshore oil and gas platform 101, according to one or more embodiments of the disclosure. Even though FIG. 1 depicts an offshore oil and gas platform 101, it will be appreciated by those skilled in the art that the well system subassembly 102, and its alternative embodiments disclosed herein, are equally well suited for use in or on other types of oil and gas rigs, such as land-based oil and gas rigs or rigs established at any other geographic location. The platform 101 may be a semi-submersible platform centered over a submerged oil and gas formation 104 located below the sea floor 106. A subsea conduit 108 extends from the deck 110 of the platform 101 to a wellhead installation 112 including one or more blowout preventers 114. The platform 101 has a hoisting apparatus 116 and a derrick 118 for raising and lowering pipe strings, such as a drill string 120.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 124 is at least partially cemented within the main wellbore 122. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The well system subassembly 102 may be installed in or otherwise form part of the casing string 124. In one or more embodiments, the subassembly 102 may include a casing joint 126 interconnected between elongate portions or lengths of the casing string 124. In other embodiments, however, the casing joint 126 may be omitted and the subassembly 102 may be arranged within a portion of the casing string 124. The well system subassembly 102 may further include a deflector tool 130 positioned within the casing string 124 and/or the casing joint 126. The deflector tool 130 has a deflector surface that may be circumferentially oriented relative to the casing joint 126 such that a casing exit 132 can be milled, drilled, or otherwise formed in the casing joint 126 (or casing string 124, where applicable) in a desired circumferential direction.

As illustrated, the casing joint 126 is positioned at a desired intersection between the main wellbore 122 and a branch or lateral wellbore 134. In some embodiments, the deflector surface in the deflector tool 130 may further be used to direct production tubing into the lateral wellbore 134 for producing fluids, such as hydrocarbon fluids, oil, gas, water, steam, etc. The terms "branch" and "lateral" wellbore are used herein to designate a wellbore which is drilled outwardly from its intersection with another wellbore, such as a parent or main wellbore. Moreover, a branch or lateral wellbore may have another branch or lateral wellbore drilled outwardly therefrom.

It will be appreciated by those skilled in the art that even though FIG. 1 depicts a vertical section of the main wellbore 122, the present disclosure is equally applicable for use in wellbores having other directional configurations including horizontal wellbores, deviated wellbores, slanted wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe or bottom of the well.

Figure 2:
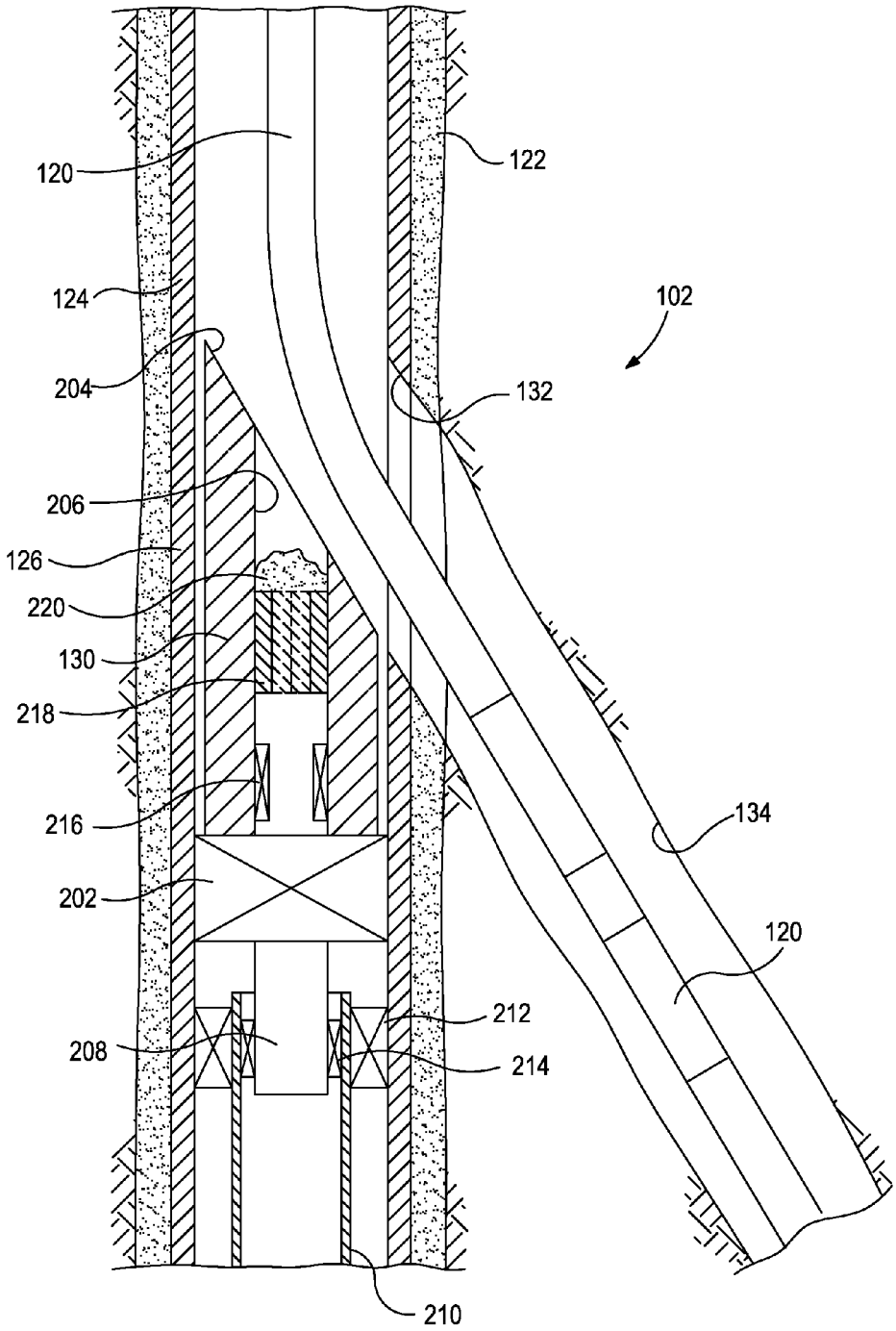
FIG. 2 illustrates an enlarged view of the well system subassembly of FIG. 1.

Referring now to FIG. 2, illustrated is an enlarged view of the exemplary well system subassembly 102, according to one or more embodiments. The deflector tool 130 may be secured in the casing joint 126 and/or the casing string 124 using a packer, latch coupling, or other type of wellbore anchoring device 202. In some embodiments, the deflector tool 130 may be a whipstock device used for deflecting a cutting tool (e.g., one or more mills) into the casing joint 126 (or casing string 124, when applicable) to mill the casing exit 132 and initiate the lateral wellbore 134. In other embodiments, the deflector tool 130 may be a completion deflector tool run into the main wellbore 122 and set at the appropriate position for deflecting a completion tool into the casing exit 132. In yet other embodiments, the deflector tool 130 may be a combination whipstock/deflector capable of performing both the operations of a whipstock device and a completion deflector tool in a single run into the main wellbore 122.

The deflector tool 130 may define a deflector surface 204 operable to direct a milling tool into the sidewall of the casing joint 126 (or casing string 124, when applicable) to create the casing exit 132. The deflector surface 204 may further be operable to direct a drilling tool through the casing exit 132 to drill and/or extend the lateral wellbore 134. As illustrated, the deflector tool 130 may define an inner bore 206 extending longitudinally from the deflector surface 204 to the downhole end of the deflector tool 130.

In some embodiments, a tail pipe 208 may extend downhole from the deflector tool 130 and be engaged with a portion of completed production tubular 210 that extends further down into the main wellbore 122. As illustrated, the completed production tubular 210 may be coupled to the casing string 124 with one or more packers 212 or other tubular stabilizing devices known in the art. The tail pipe 208 may further include one or more completion seals 214 disposed about its outer circumference and configured to seal against the inner surface of the completed production tubular 210. Accordingly, as the deflector tool 130 is being set, the tail pipe 208 may be "stung" into the production tubular 210 and the completion seals 214 may be configured to provide a sealed connection between the tail pipe 208 and the lower production tubular 210. In other embodiments, the one or more completion seals 214 may be disposed about the inner surface of the completed production tubular 210 and serve the same purpose, without departing from the scope of the disclosure. In yet other embodiments, the production tubular 210 may be sealingly secured directly to the anchoring device 202 and/or deflector tool 130, thereby providing a sealed connection between the deflector tool 130 and the production tubular 210.

The well system subassembly 102 may further include one or more seal stacks 216 and a wellbore barrier device 218. The one or more seal stacks 216 may be disposed about the inner surface of the inner bore 206 (e.g., disposed about the inner diameter of the inner bore 206). As will be described in more detail below, the seal stack 216 may be configured to receive and seal a production tubular extended from the surface. The wellbore barrier device 218 may also be disposed about the inner surface of the inner bore 206 of the deflector tool 130. In operation, the wellbore barrier device 218 may be configured to protect the seal stack 216 and the lower portions of the main wellbore 122 from damage caused by milling/drilling debris 220. Debris 220 may damage the seal stack 216 and result in underperforming hydrocarbon production or the production of sand through the seal stack 216. Accumulated debris 220 may also plug the inner bore 206 or lower bores (e.g., the completed production tubular 210), thereby preventing follow on operations, such as retrieving whipstocks or deflectors.

In one or more embodiments, the wellbore barrier device 218 may be a swellable elastomer configured to swell or expand inwardly from the inner diameter of the inner bore. The swellable elastomer may be made of any known swelling elastomeric material. In other embodiments, however, the wellbore barrier device 218 may be a swell packer, as known by those skilled in the art, and configured to expand or swell in response to a predetermined wellbore pressure, temperature, mechanical/hydraulic/electronic actuation mechanism, etc.

As illustrated in FIG. 2, the wellbore barrier device 218 is shown as a swellable elastomer configured to swell from an unswelled state or configuration, to a swelled state or configuration (as shown by the dashed lines). Once in position in the main wellbore 122, the swelling could take place through exposure to the ambient wellbore fluids or by spotting an appropriate catalyst fluid through the running string. For example, the swellable elastomer may be configured to react with various downhole media such as, but not limited to, water, hydrocarbons, wellbore chemicals, combinations thereof, or the like.

Figure 3A:
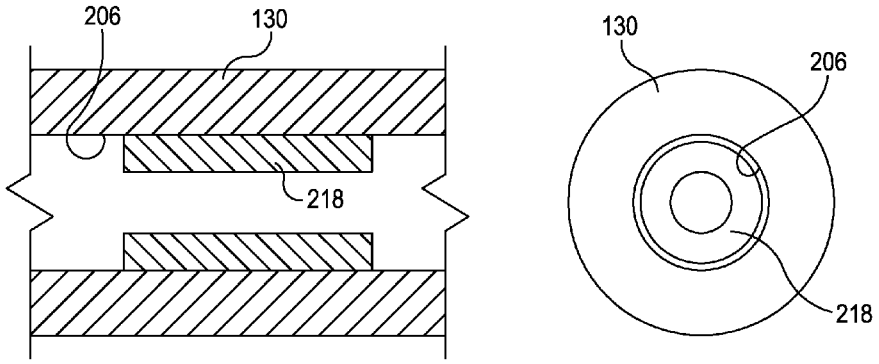
FIGS. 3*a* and 3*b* illustrate an exemplary swellable elastomer in its unswelled and swelled configurations, respectively, according to one or more embodiments disclosed.
Figure 3B:
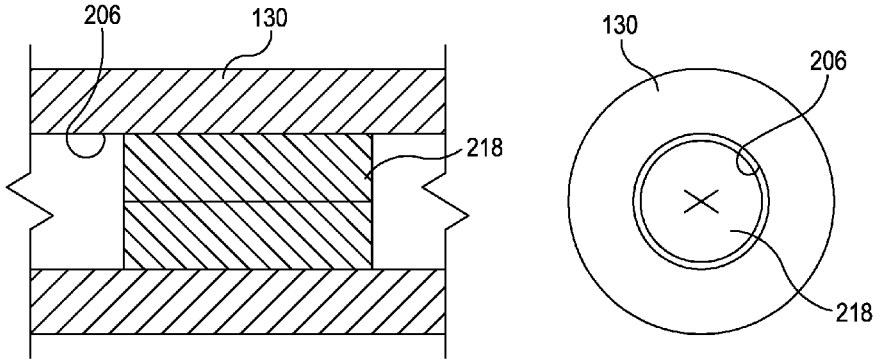

Referring now to FIGS. 3*a* and 3*b*, illustrated is the exemplary wellbore barrier device 218 in its unswelled and swelled configurations, respectively. As the deflector tool 130 is run into the main wellbore 122 (FIGS. 1 and 2), the wellbore barrier device 218 may be in its unswelled configuration. Having the wellbore barrier device 218 in the unswelled configuration may prove advantageous since it may allow for fluid by-pass through the wellbore barrier device 218 as the deflector tool 130 is run. Since the wellbore 122 will likely be filled with fluid(s), once the tail pipe 208 has engaged the seals 214, if there were no fluid by-pass through the wellbore barrier device 218, an incompressible hydraulic lock could result, thereby preventing further advancement of the deflector tool 130 or wellbore barrier device 218. As a result, the deflector tool 130 would not be capable of advancing all the way to depth. Conversely, if the deflector tool 130 needs to be retrieved and the wellbore barrier device 218 is swelled and the seals 214 are properly engaged with the tail pipe, it may be difficult to retract the tail pipe 208 out of the seals 214 (i.e., suction pressures within the completed production tubular 210 would prevent this from occurring).

Once the deflector tool 130 is lowered to and set at its predetermined depth in the main wellbore 122, however, the wellbore barrier device 218 may be configured to initiate swelling to its swelled configuration. In some embodiments, the swelled configuration creates a pressure tight seal in the inner bore 206, thereby effectively isolating the portions above and below the wellbore barrier device 218. In other embodiments, however, the wellbore barrier device 218 does not necessarily provide a fluid tight seal in its swelled configuration. Instead, the wellbore barrier device 218 may be configured to swell radially inward to generally fill the axial portion of the inner bore 206 covered by the wellbore barrier device. As a result, the wellbore barrier device 218 serves as a physical barrier from debris 220 (FIG. 2) generated through milling the casing exit 132 and/or drilling of the lateral wellbore 134 (FIGS. 1 and 2).

Figure 4:
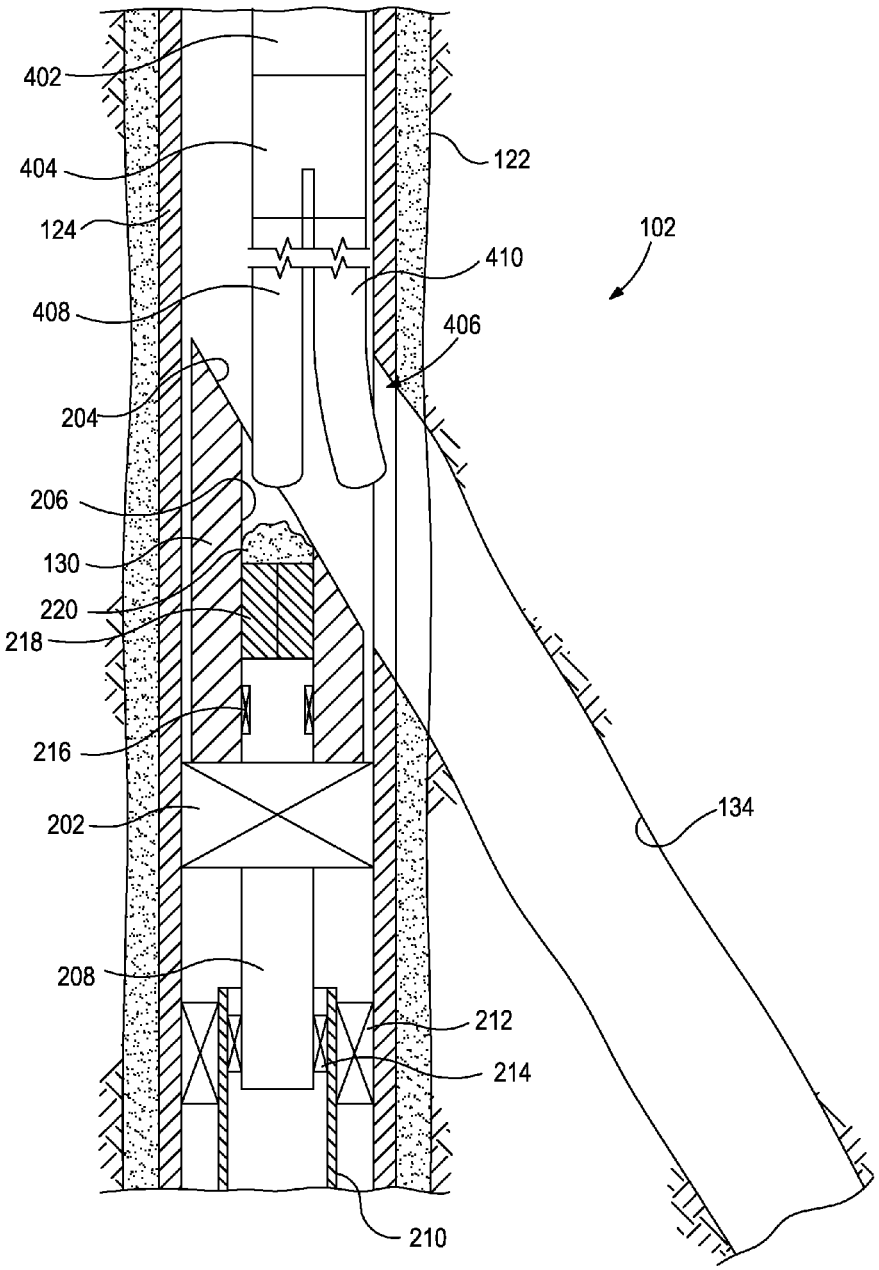
FIG. 4 illustrates another enlarged view of the well system subassembly of FIG. 1 as used in conjunction with a production tubular string, according to one or more embodiments.

Referring now to FIG. 4, illustrated is the well system subassembly 102 after the lateral wellbore 134 has been drilled and the wellbore barrier device 218 has assumed its swelled configuration, according to one or more embodiments. After the necessary operations are performed in the lateral wellbore 134, a tubular string 402 may be extended down into the main wellbore 122 in an effort to complete the well and initiate hydrocarbon production. As illustrated, a completion tool 404 may be coupled to the tubular string 402 and also run into the main wellbore 122. The completion tool 404 may eventually be set at or near the casing exit 132, thereby establishing a lateral junction 406. In one or more embodiments, the completion tool 404 may be a screen or some other contrivance configured to prevent undesired entrance of solids and/or fluids from a formation proximate the casing exit 132 into either the main wellbore 122 or the lateral wellbore 134. The junction 406 may be in conformance with one of the levels defined by the technology advancement for multilaterals (TAML) organization, for example a TAML Level 5 multilateral junction.

The completion tool 404 may separate the tubular string 402 into at least a first production tubular 408 and a second production tubular 410. The first production tubular 408 may be configured to extend further into the main wellbore 122, and the second production tubular 410 may be configured to extend into the lateral wellbore 134. In order to sealingly couple or engage the tubular string 402 to the completed tubular string 210 downhole, the first production tubular 408 may be configured to penetrate the swollen wellbore barrier device 218 and subsequently "sting" into the seal stack 216 as the tubular string 402 advances downhole.

Prior to penetrating the swollen wellbore barrier device 218, however, the accumulated debris 220 may be required to be removed or otherwise washed off of the swollen wellbore barrier device 218. In some embodiments, the debris 220 may be removed or washed away through the circulation and injection a fluid through the first production tubular 408. In other embodiments, the debris 220 may be washed away through the injection and circulation of a fluid through any string or tubular that enters the main wellbore 122 after the wellbore barrier device 218 has assumed its swelled configuration. In yet other embodiments, the debris 220 may be removed through suction means, such as by using a downhole vacuum tool or removing the debris 220 by physically "bailing" the debris 220 out.

Figure 5:
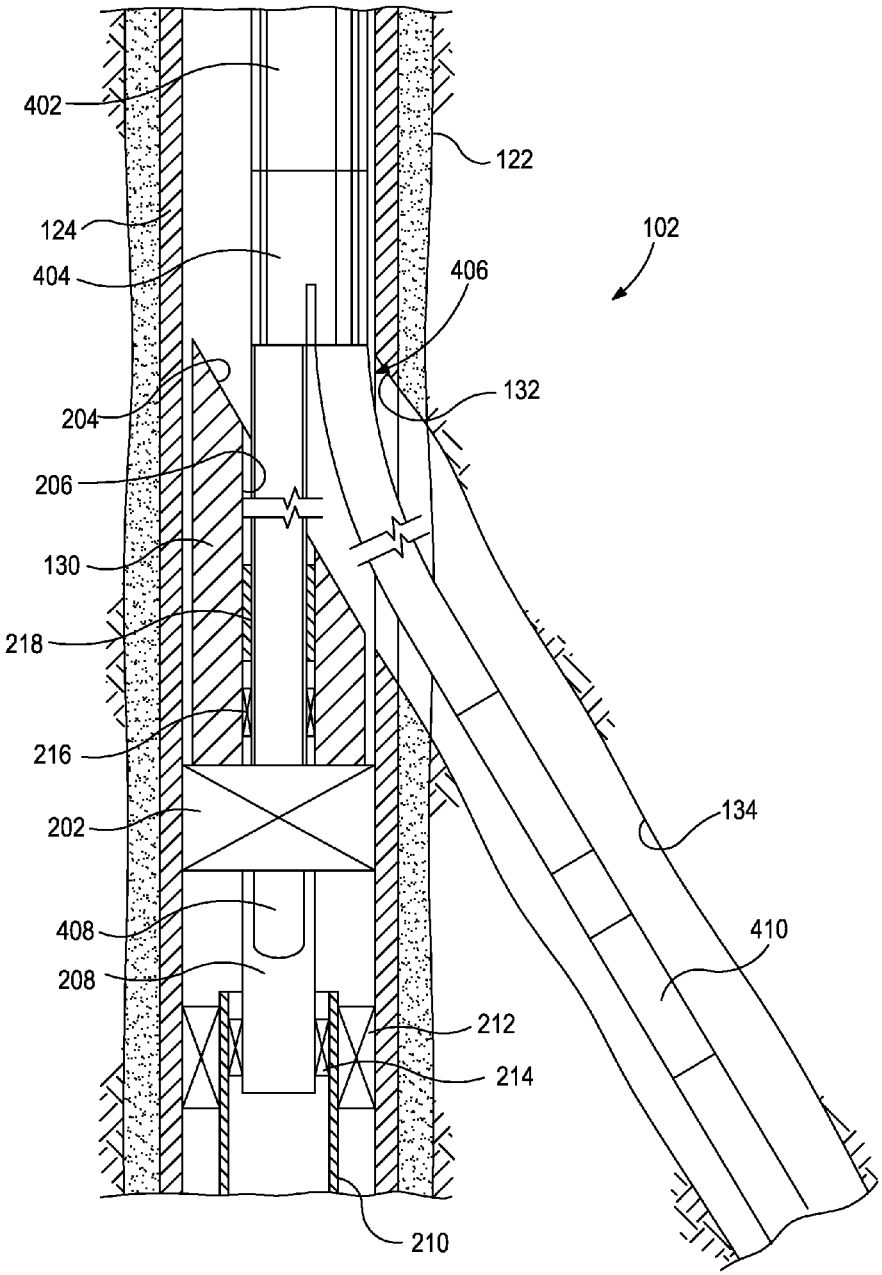
FIG. 5 illustrates another enlarged view of the well system subassembly of FIG. 1 as used in conjunction with a production tubular string, according to one or more embodiments.

Referring now to FIG. 5, once the debris 220 (FIG. 4) is adequately removed from the swelled wellbore barrier device 218, the first production tubular 408 may then be advanced into the inner bore 206 until contacting the swelled wellbore barrier device 218. With sufficient set-down force applied to the tubular string 402, the first production tubular 408 may penetrate and be pushed through the swollen wellbore barrier device 218. Advancing the tubular string 402 further downhole may eventually "sting" the first production tubular 408 into the seal stack 216 and thereby place the tubular string 402 in sealed communication with the completed production tubular 210 therebelow.

During production operations in the formation 104 (FIG. 1), the penetrated wellbore barrier device 218 may sealingly engage the outer diameter of the first production tubular 408 and thereby continue to provide a debris barrier around the first production tubular 408. In one or more embodiments, in the event the tubular string 402 and accompanying first and second production tubulars 408, 410 are removed from the main wellbore 122, the wellbore barrier device 218 may be configured to return to its swelled configuration and continue to provide a debris barrier for the seal stack 216 and lower bore elements and components.

A method of installing the wellbore system subassembly 102 in a well is also disclosed herein. The method includes arranging a deflector tool having an inner bore within a casing string cemented into the well. The deflector tool may have one or more seal stacks and a wellbore barrier device disposed about the inner bore. The wellbore barrier device is arranged uphole from the one or more seal stacks. The method further includes expanding the wellbore barrier device inwardly from an unswelled configuration to a swelled configuration, and protecting with the swelled wellbore barrier device the one or more seal stacks from debris. The method may also include advancing a tubular string into the casing string, where the tubular string is separated into at least a first production tubular and a second production tubular, and penetrating the swelled wellbore barrier device with the first tubular string.

The method may further include advancing the deflector tool within the casing string while the wellbore barrier device is in the unswelled configuration. In some embodiments, prior to penetrating the swelled wellbore barrier device the method further includes removing accumulated debris from the swelled wellbore barrier device. In some embodiments, removing the accumulated debris from the swelled wellbore barrier device includes injecting a fluid through the first production tubular, and washing the debris away from the swelled wellbore barrier. In some embodiments, expanding the wellbore barrier device inwardly includes exposing the wellbore barrier device to downhole media. In other embodiments, expanding the wellbore barrier device inwardly includes exposing the wellbore barrier device to a catalyst fluid injected into the well. In some embodiments, the method further includes removing the first production tubular from the wellbore barrier device, and allowing the wellbore barrier device to expand back into the swelled configuration.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A well system subassembly, comprising:

a deflector tool arranged within a casing string and defining a deflector surface and an inner bore extending longitudinally from the deflector surface;

one or more seal stacks disposed about the inner bore of the deflector tool;

a wellbore barrier device disposed about the inner bore and arranged uphole from the one or more seal stacks and being expandable from an unswelled configuration, where fluid flow through the inner bore is allowed, to a swelled configuration, where the wellbore barrier device swells radially inward and fills the inner bore, wherein the wellbore barrier device in the swelled configuration protects the one or more seal stacks from debris generated from milling and/or drilling operations; and a tail pipe coupled to and extending downhole from the deflector tool, the tail pipe being sealed against an inner surface of a completed production tubular arranged in the casing string downhole from the deflector tool.

2. The subassembly of claim 1, wherein the deflector tool is a whipstock device.

3. The subassembly of claim 1, wherein the deflector is a combination whipstock/deflector tool.

4. The subassembly of claim 1, wherein the wellbore barrier device is a swellable elastomer.

5. The subassembly of claim 4, wherein the swellable elastomer swells to the swelled configuration by being exposed to downhole media.

6. The subassembly of claim 4, wherein the swellable elastomer swells to the swelled configuration by spotting an appropriate catalyst fluid through a running string run into the casing string.

7. The subassembly of claim 1, wherein the wellbore barrier device is a swell packer.

8. The subassembly of claim 1, wherein the swelled configuration creates a pressure tight seal in the inner bore.

9. A method of installing a wellbore system subassembly in a well, comprising:

arranging a deflector tool within a main wellbore, the deflector tool defining an inner bore and having one or more seal stacks and a wellbore barrier device disposed about the inner bore, wherein the wellbore barrier device is arranged uphole from the one or more seal stacks;

expanding the wellbore barrier device inwardly from an unswelled configuration, where fluid flow through the inner bore is allowed, to a swelled configuration, where the wellbore barrier device swells radially inward and fills the inner bore;

drilling a lateral wellbore that extends from the main wellbore;

protecting the one or more seal stacks from debris with the wellbore barrier device in the swelled configuration;

advancing a tubular string into the main wellbore, the tubular string being separated into at least a first production tubular and a second production tubular; and penetrating the swelled wellbore barrier device with the first production tubular and sealingly engaging the one or more seal stacks with the first production tubular.

10. The method of claim 9, wherein arranging the deflector tool within the main wellbore further comprises advancing the deflector tool within the main wellbore with the wellbore barrier device in the unswelled configuration.

11. The method of claim 9, further comprising advancing the second production tubular into the lateral wellbore.

12. The method of claim 9, wherein prior to penetrating the swelled wellbore barrier device the method further comprises removing accumulated debris from the swelled wellbore barrier device.

13. The method of claim 12, wherein removing the accumulated debris from the swelled wellbore barrier device comprises:

injecting a fluid through the first production tubular; and washing the debris away from the swelled wellbore barrier.

14. The method of claim 9, wherein expanding the wellbore barrier device inwardly comprises exposing the wellbore barrier device to downhole media.

15. The method of claim 9, wherein expanding the wellbore barrier device inwardly comprises exposing the wellbore barrier device to a catalyst fluid injected into the well.

16. The method of claim 9, further comprising:

removing the first production tubular from the wellbore barrier device; and allowing the wellbore barrier device to expand back into the swelled configuration.

17. The method of claim 9, further comprising inserting a tail pipe coupled to and extending downhole from the deflector tool into a production tubular secured within the main wellbore.

18. A well system subassembly, comprising:

a combination whipstock/deflector defining a deflector surface and an inner bore extending longitudinally from the deflector surface;

one or more seal stacks disposed about the inner bore of the combination whipstock/deflector;

a swellable elastomer disposed about the inner bore and arranged above the one or more seal stacks, the swellable elastomer being expandable from an unswelled configuration, where fluid flow through the inner bore is allowed, to a swelled configuration, where the wellbore barrier device swells radially inward and fills the inner bore, wherein the swellable elastomer in the swelled configuration protects the one or more seal stacks from debris; and a tail pipe coupled to and extending downhole from the combination whipstock/deflector, the tail pipe being sealed against an inner surface of a completed production tubular arranged in the casing string downhole from the combination whipstock/deflector.

19. The subassembly of claim 18, wherein the swellable elastomer swells to the swelled configuration by being exposed to downhole media.

20. The subassembly of claim 18, wherein the swellable elastomer is able to be penetrated by a production tubular.

* * * * *